US005165571A

United States Patent [19]

Schlumpf

[11] Patent Number: 5,165,571

[45] Date of Patent: Nov. 24, 1992

[54] VENDING MACHINE FOR NEWSPAPERS OR MAGAZINES

[75] Inventor: Alois Schlumpf, Zumikon, Switzerland

[73] Assignee: Journomat AG, Zurich, Switzerland

[21] Appl. No.: 299,162

[22] Filed: Jan. 19, 1989

Related U.S. Application Data

[63] Continuation of Ser. No. 165,218, Mar. 8, 1988, abandoned.

[30] Foreign Application Priority Data

Mar. 9, 1987 [CH] Switzerland ..... 884/87

[51] Int. Cl.[5] ..... G07F 11/14

[52] U.S. Cl. ..... 221/213; 194/346; 221/232

[58] Field of Search ..... 221/213, 214, 215, 216, 221/232; 194/346

[56] References Cited

U.S. PATENT DOCUMENTS 4,296,873 10/1981 Schlumpf ..... 221/213

FOREIGN PATENT DOCUMENTS 1420601 1/1976 United Kingdom ..... 221/213

*Primary Examiner*—F. J. Bartuska

*Attorney, Agent, or Firm*—Blum Kaplan

[57] ABSTRACT

A vending machine for newspapers includes a housing and an upwardly biased support table (15) for receiving a supply stack of newspapers vertically movable within the housing. A control handle (35) pulls a slide (32) forward. The slide (32) supports a pivotable arm (37) for moving the uppermost newspaper of the stack over a guide plate (53) into a withdrawal slot. A three-quarter circular-cylindrical segment-shaped roller (39) having at least one projection (41) is rotatably mounted at the forward end of the arm. In the rearward base position, the forward end of the arm is lifted away from the stack by a slide (45).

13 Claims, 6 Drawing Sheets

55
54

23a
22
117
53
118
124
23
120
122
119
121
15
116
123

VENDING MACHINE FOR NEWSPAPERS OR MAGAZINES

CROSS REFERENCE TO RELATED APPLICATIONS

This is a continuation application of U.S. application Ser. No. 165,218 filed on Mar. 8, 1988 now abandoned.

BACKGROUND OF THE INVENTION

The invention relates in general to vending machines and in particular to vending machines for newspapers, magazines, or similar wide-area multi-page print products.

Such a vending machine is known from European Patent No. 12,719 and U.S. Pat. No. 4,296,873. This machine has a housing in which there is a horizontal table to receive the supply stack of newspapers. The horizontal table is guided on lateral rails so as to move perpendicularly. The table is pulled upwards by two synchronized, spring-loaded pulley blocks acting against a braking device which brakes the pull of the pulley blocks. Above the stack, a separating element having spikes disposed thereon can be pivoted in a horizontal plane. The separating element is activated through a pivoted lever having a control handle. If the correct number of coins is inserted in a cash receiving station, the separating element is unlocked through an electromagnet. When the control lever is moved, the spikes of the operating element then grip the uppermost copy of the stack of newspapers, and push this copy out through a withdrawal slot. As the control lever completes its motion, it empties the coins contained in the coin receiving station into a collection container. When the supply of newspapers is exhausted, a flap with the lettering "empty"—which previously was always held up by the uppermost copy—falls down.

This prior art vending machine has been satisfactory; however, the separating element occasionally malfunctions. Accordingly, it is desirable to provide a vending machine which overcomes the shortcoming of the prior art.

SUMMARY OF THE INVENTION

Generally speaking, in accordance with the invention, a vending machine for multi-page print products having an improved separating element is provided. The vending machine includes a housing and a support table disposed within the housing. The table is vertically movable and is upwardly biased for receiving a supply stack of newspapers. An activation device equipped with a control handle is supported within the housing and has at least one spike to push the uppermost newspaper of the stack through a withdrawal slot. The activation device includes an arm which is disposed above the support table. The arm is pivotably supported about an approximately horizontal first axle. A body containing the spike is mounted at the front end of the arm so as to pivot about a horizontal second axle, and is maintained in a first position by an element activated by an electromagnet. In this first position, the spike is raised from the stack.

A coin receiving station receives coins. The electromagnet is connected to the coin receiving station to activate the element and to lower the spike onto the stack after testing the amount paid at the coin receiving station. The body includes a roll surface that is substantially coaxial with the second axle. The roll surface lies on the pushed-ahead newspaper when the arm is moved backwards. When the roll surface rolls off the newspaper, the body is returned to the first position, in which the element catches the body. A device is disposed at the arm for raising the body off the stack in the rearward limit position of the activation device.

It is an object of this invention to provide an improved vending machine for multi-page print products.

Another object of this invention is to provide a vending machine having a separating element which reliably operates.

Still other objects and advantages of the invention will in part be obvious and will in part be apparent from the specification and drawings.

The invention accordingly comprises features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF THE PREFERRED EMBODIMENTS

Figure 1:
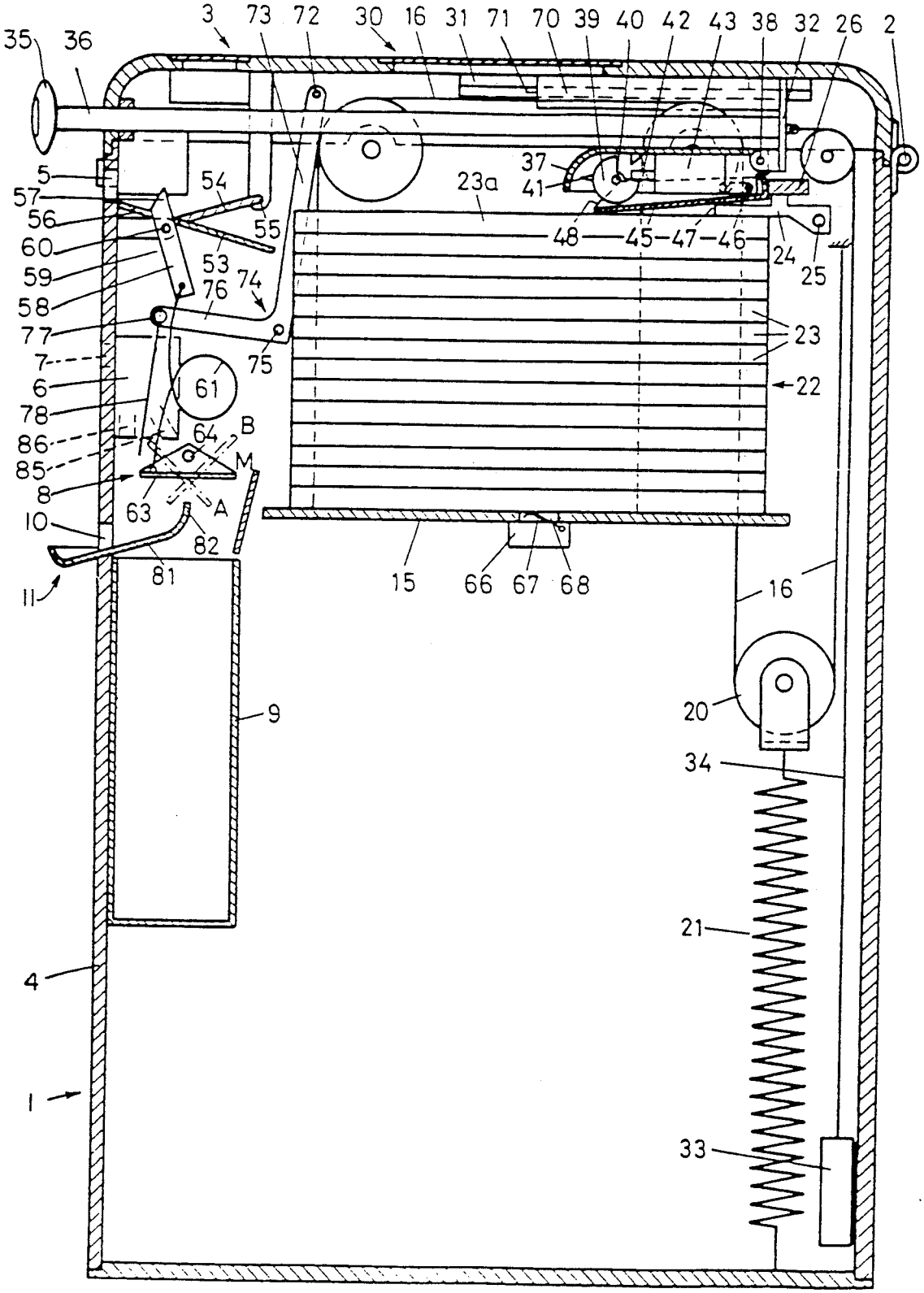
FIG. 1 shows a cross sectional view of a vending machine constructed in accordance with the invention.

Reference is first made to FIGS. 1 through 6 wherein a vending machine constructed in accordance with the invention is shown. Vending machine 100 has a housing 1 closed on all sides. A cover 3 is pivotably attached along the upper rear edge of housing 1 by hinges 2. A horizontal withdrawal slot 5 is cut into a front panel 4 of housing 1. A coin receiving station 6 having several coin insert slots 7 is fastened at front panel 4. Coin receiving station 6 checks the coins as inserted. An intermediate coin handling station 8 is positioned below coin insert slots 7. Intermediate coin handling station 8 empties the coins that have been checked by the coin receiving station 6 into either a collection container 9 or through a slot 10 in the front panel 4 into a return cup 11. Coin receiving station may also have a slot for inserting a magnetic stripe payment card.

A table 15 designed as a flat plate is suspended on four ropes 16 within housing 1. The two ropes 16 which are affixed at a first pair of side edges 17, 18 of the table 15 are conducted via a common guide pulley 19 to a common pulley block by a pulley 20. The ends of ropes 16 are fastened on top at the side wall of housing 1. A spring 21 tensions pulley 20 downwards. This design achieves a very simple, space-saving parallel guidance of table 15 in the longitudinal direction. Additionally, table 15 can tilt somewhat in the transverse direction by deflecting each pulley block 20 differently. This has the advantage that all newspapers 23 can be inserted in the stack 22 with their fold on the same side. The fold causes the two sides of the stack 22 to have a different height, but this is automatically compensated by slightly tipping the table 15.

A stop 24 is pivotably mounted about an axle 25. Springs 21 are dimensioned so that they lift stack 22 of newspapers 23, which lie on table 15 up to stop 24 positioned at the rear edge of stack 22, independently of the height of the stack. In the horizontal base position, (FIG. 1) stop 24 contacts a stopping block 26 which is fixed in the housing. When stack 22 is pressed down the weight of stack 22 causes stop 24 to swing downwards through a limited range facilitating the refilling of newspapers 23. A longitudinal guiding rib 27 extends through the middle of stop 24 (FIG. 6) so that an uppermost newspaper 23*a* is initially guided longitudinally as it is pushed forward.

Figure 2:
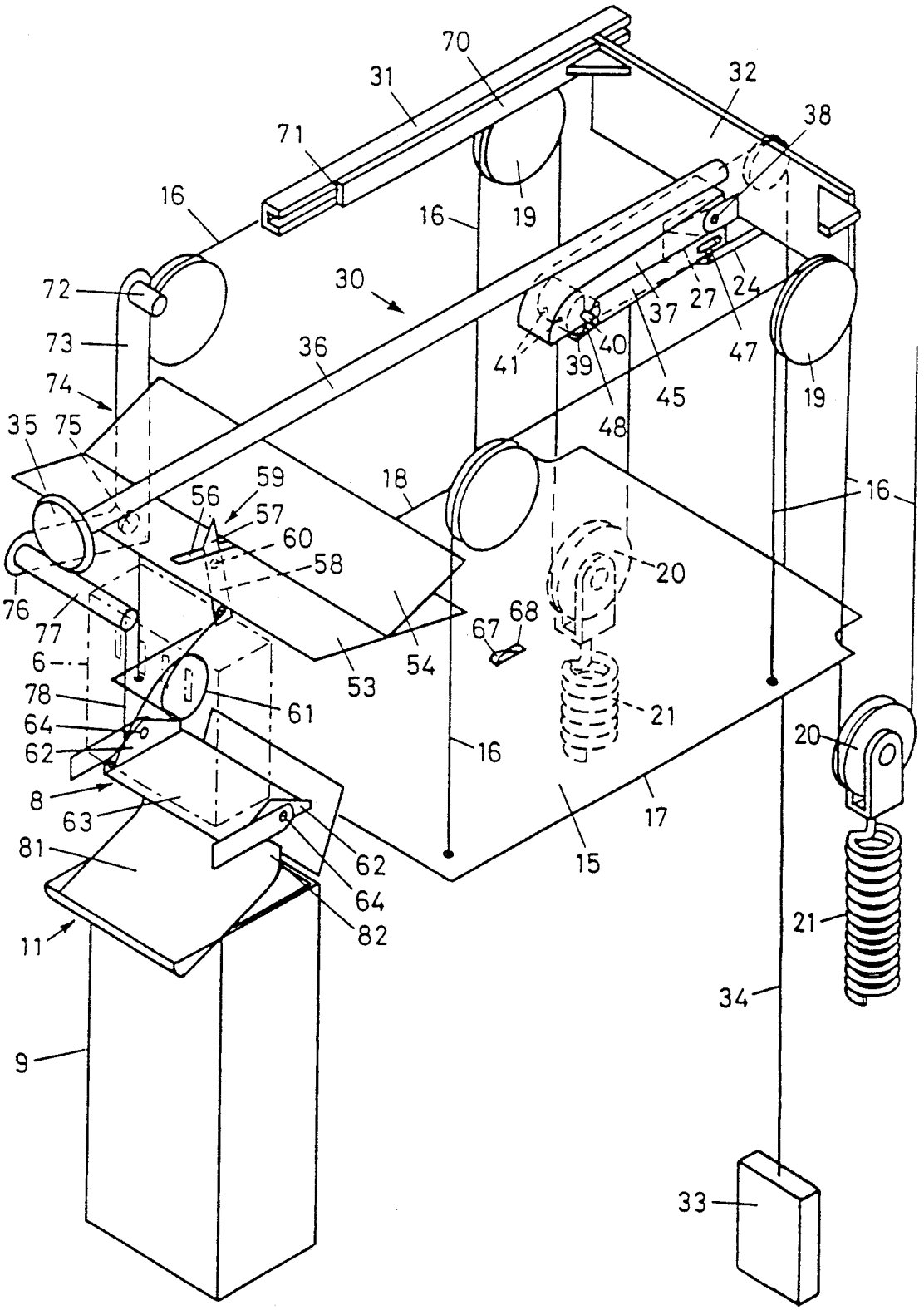
FIG. 2 shows a perspective view of the interior parts of the vending machine.
Figure 4:
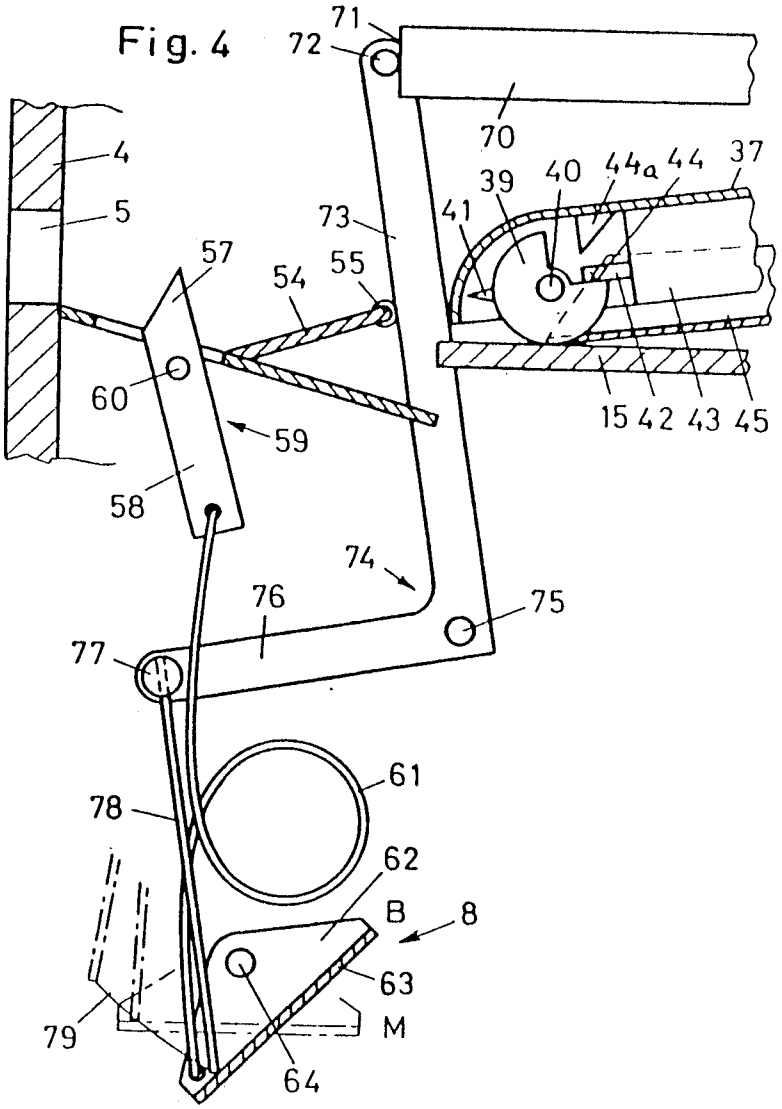
FIG. 4 is a schematic view of a completely dispensed vending machine.

An activation device, generally indicated as 30, for pushing uppermost newspaper 23*a* of stack 22 out of slot 5 is mounted in cover 3. Device 30 includes a slide 32 that is guided by two horizontal rails 31 (only the left rail is shown in FIG. 2). A rope 34 loaded with a weight 33 pulls slide 32 rearward. Slide 32 can be pulled forward manually by pulling a control knob 35, linked to slide 32 by a pull rod 36, which extends without the front edge of cover 3. A forwardly extending arm 37 is fastened to slide 32 so that arm 37 can pivot about a horizontal axle 38. A roller 39 adjacent the free end of arm 37 formed in the shape of a three-quarter circular segment is rotatably mounted about a horizontal axle 40.

Figure 3:
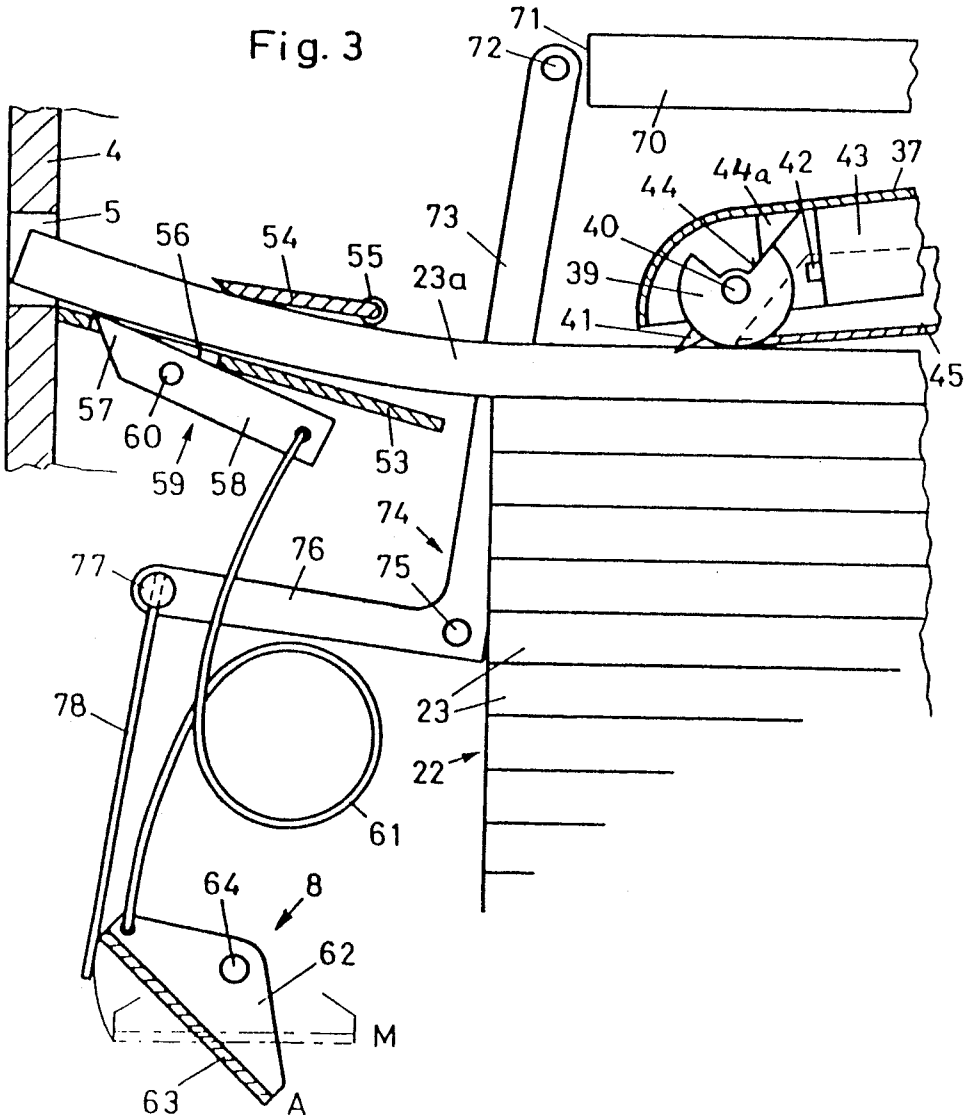
FIG. 3 is a schematic view of a newspaper being ejected.

In the inoperative or closed position two spikes 41 protrude from roller 39. An electromagnet 43 abuts a radial surface 44 of roller 39. An armature 42 of electromagnet 43 with a radial surface 44 keeps roller 39 in the inoperative position. When electromagnet 33 is excited the armature 42 is pulled back and roller 39 swings away through its eccentric weight until the radial surface 44 contacts a stop 44*a* of arm 37. In this position spikes 41 extend down and forward (FIG. 3). When slide 32 is in the rear base position, arm 37 is lifted from stack 22 by a slide 45 being stopped at stopping block 26 (FIG. 1).

Slide 45 can be pivoted and displaced with respect to arm 37 by a pin 46 positioned in a longitudinal groove 47. Slide 45 lies with its forward end on stack 22. Upon contact with block 26, a slanted front edge 48 of slide 45 raises laterally protruding axle 40. Thus, the ejecting height of roller 39 is independent of possible skew positioning of uppermost newspaper 23*a*.

Station 6 activates magnet 43 after coins have been inserted through slot 7 and coin receiving station 6 has recorded an amount corresponding to the purchase price. Spikes 41 then swing downward. When control knob 35 is pulled outwardly away from housing 1 spikes 41 grip uppermost newspaper 23*a* of stack 22. Slide 32 then moves forward causing spikes 41 to push uppermost newspaper 23*a* in the direction of withdrawal slot 5. A holder plate 54 holds down top newspaper 23*a* as it is guided by a guide plate 53 which adjoins the lower edge of slot 5. The rear edge of plate 54 can pivot about a horizontal axle 55. In the inoperative position, plate 54 lies on guide plate 53 forming an acute angle. By its weight plate 54 presses against newspaper 23*a* which has been pushed forward. Consequently, newspaper 23*a*, independent of its number of pages, presses a sensing arm 57 counterclockwise about its pivoting axle 60 (FIG. 3). Sensing arm 57 projects through a slot 56 in the guide plate 53 and belongs to a sensor 59 designed as pivoting lever 58.

A loop-shaped bent spring 61 is attached at the other end of pivoting lever 58. The other end of the bending spring 61 is flexibly connected to the front end of a plate 63 forming intermediate station 8. Plate 63 has two laterally bent tabs 62. Tabs 62 can be pivoted about a horizontal pin 64. Plate 63 swings clockwise from a center position indicated by the broken line position M to a discharge position indicated by the solid line position A when sensing arm 57 is pressed down by newspaper 23*a*. In the discharge position A the coins having passed through slots 7 now lying on plate 63 are tilted into collection container 9.

If the correct purchase price was not input into coin receiving station 6 or if the supply of newspapers has been deleted magnet 43 is not activated. For this purpose, the electric current transmitted from coin receiving station 6 to magnet 43 is led through the normally open contacts of a switch 66 positioned under the middle of table 15. A sensing arm 67 of switch 66 extends through a slot 68 of table 15. If a stack 22 is lying on the table 15, the sensing arm 67 is pressed closing switch 66 and thus connecting magnet 43 to coin receiving station 6. When the supply chamber is empty no newspapers are lying on the table 15 and when control knob 35 is pulled, spikes 41 remain in their raised position.

A rod 70 extends forward at the left side of slide 32. Rod 70 is used for the parallel guidance of slide 32 and, while its front surface also forms a lug 71. Towards the end of the slide path lug 71 strikes against a pin 72 at the free end of arm 73 of a double-arm lever 74. Lever 74 pivots about a horizontal axle 75 in housing 1. Another arm 76 supports a horizontal pin 77 at its free end. A downwardly extending spring rod 78 is inserted at the inside end of horizontal pin 77. When slide 32 is pulled all the way forward by pulling control knob 35, lug 71 of rod 70 pushes pin 72 forward and pivots double-armed lever 74 counterclockwise. The free end of spring rod 78 traces a path 79 causing spring rod 78 to strike the horizontal, flat plate 63 of intermediate coin handling station 8 while plate 63 is in its inoperative position. When spring rod 78 strikes plate 63, plate 63 swings counterclockwise to a discharge position B against the force of spring 61.

Coins are discharged onto a forwardly and downwardly slanted plate 81 of return cup 11. A rear edge 82 of cup 11 is bent vertically upwards and is disposed perpendicularly under pin 64. The coins lying on intermediate coin handling station 8 then pass through slot 10 into return cup 11. Lever 74 and spring rod 78 are disposed in such a way that in their initial position they do not impede the pivoting of intermediate coin handling station 8 in the clockwise direction.

Four coin insertion slots 7 are provided in coin receiving station 6. A test station is associated with each insertion slot 7 which tests e.g. the diameter, thickness and weight of the coin. When a coin has been recognized as genuine, it is delivered through a first channel 85 to the intermediate coin handling station. At the same time, a number of pulses corresponding to the value of the coin are added by a counting unit. When the content of the counting unit corresponds to the purchase price, the magnet 43 is activated by switch 66.

Coins which are not genuine are stored in a storage channel 86 of which there is one for each test station. All the channels 86 join before the intermediate coin handling station 8 and are blocked by a common block which can be unlocked by a return lever 87 which protrudes laterally at the coin receiving station 6. Return lever 87 is activated by the front end 80 of pin 77 immediately before reaching the forward end stop of slide 32. Then all four storage channels 86 open and the defective coins contained therein fall directly on plate 81 and into return cup 11, independent of the position of the intermediate coin handling station 8. This results in a very simple and reliable operation of the vending machine, since neither a return key nor an empty indicator are required.

Figure 7:
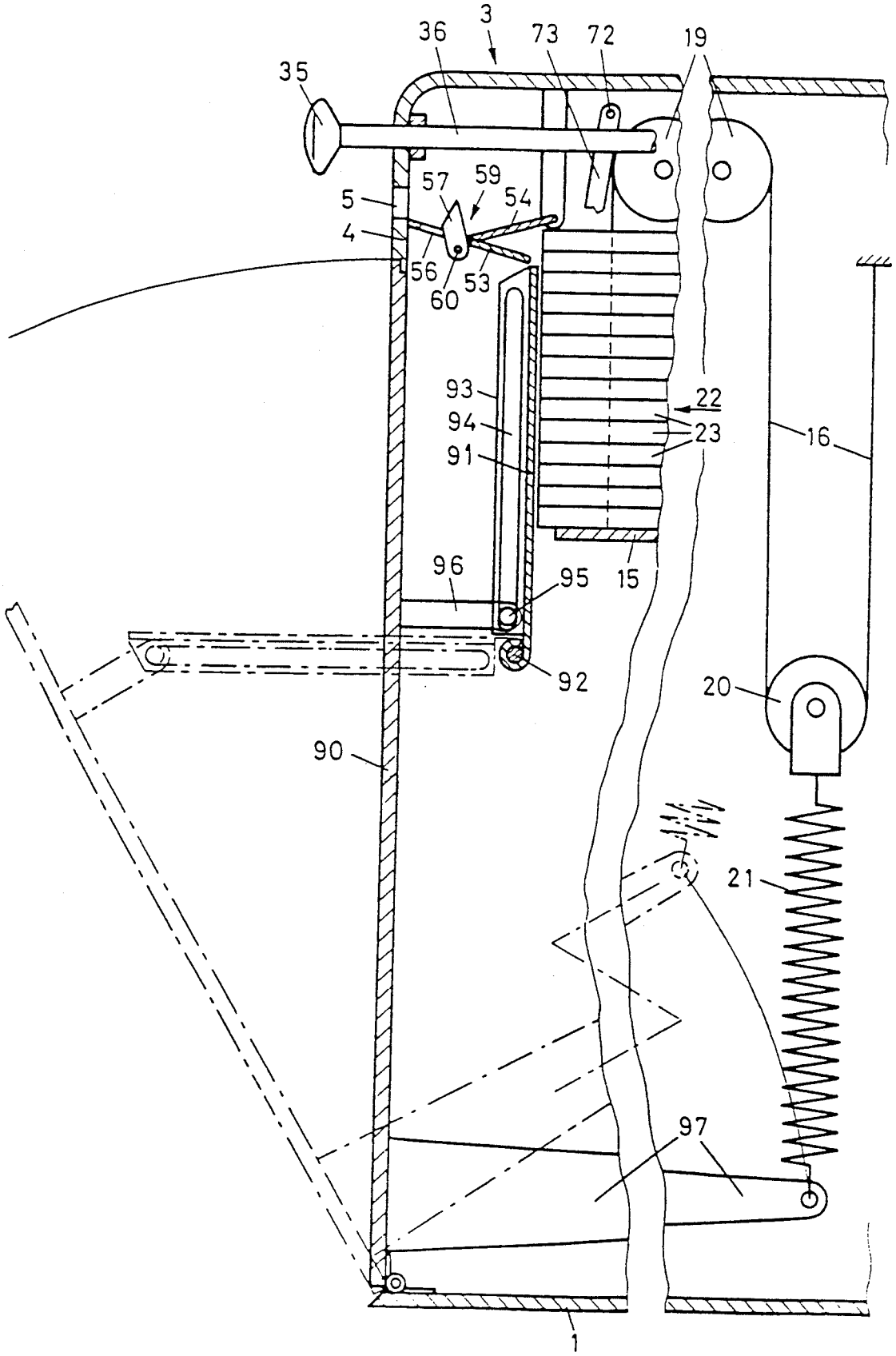
FIG. 7 is a cross sectional view of a second embodiment of a vending machine in accordance with the invention.

Reference is made to FIG. 7 wherein a vending machine in accordance with a second embodiment of the invention is provided. Like numerals are used to indicate like parts and the principal difference being that cover 3 is fastened rigidly on housing 1 but a door 90 is pivotably attached to front panel 4 at its lower edge. Coin receiving station 6, intermediate coin handling station 8, collection container 9, and return cup 11 (all not shown) are mounted on front panel 4 and are displaced laterally with respect to stack 22. For this purpose, the lower arm of pivoting lever 58 is displaced laterally with respect to sensing arm 57 and is connected thereto through pivoting axle 60.

Behind door 90, a plate 91 can be pivoted about a horizontal axle 92. When door 90 is closed, plate 91 is vertical. During operation, plate 91 serves as a forward stop for stack 22. When door 90 is open, plate 91 swings into a horizontal position and serves as the table. For this purpose, a rail 93 with a longitudinal groove 94 is fastened at plate 91. A pin 95 engages longitudinal groove 94. Pin 95 is inserted into a support 96 that is fastened to door 90. An arm 97 protrudes from the bottom of door 90. Spring 21 is fastened at arm 97 so that when door 90 is opened spring 21 is relieved of tension; lowering table 15. Table 15 can then be conveniently loaded from the front. The remainder of the second embodiment corresponds to the first embodiment of FIGS. 1 through 6.

Figure 8:
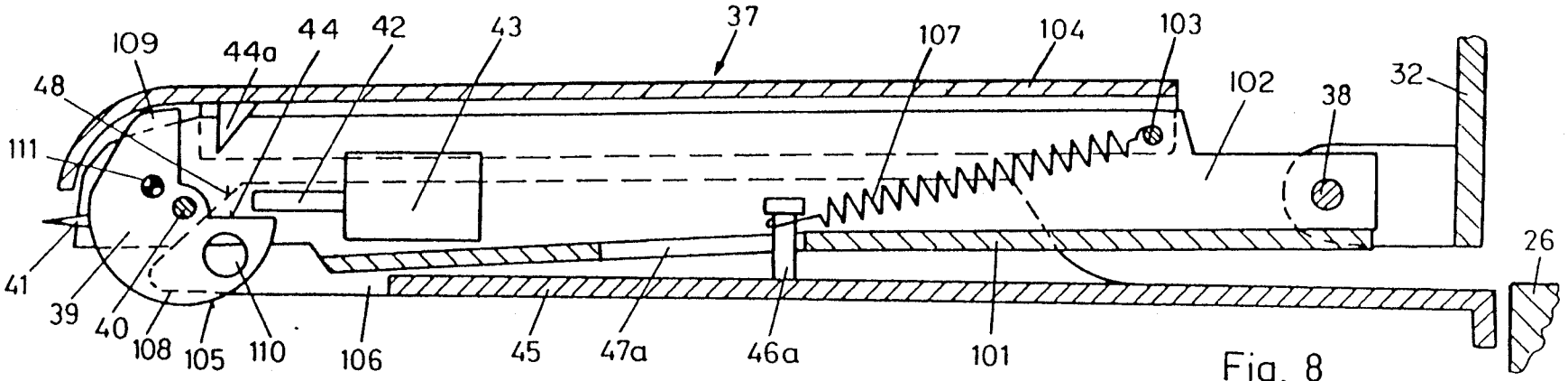
FIG. 8 is an enlarged sectional view of the separating element in accordance with the invention.
Figure 6:
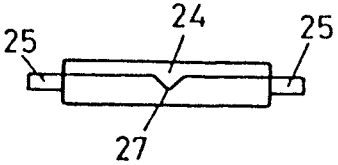
FIG. 6 is a front elevational view of a stop in accordance with the invention.
Figure 5:
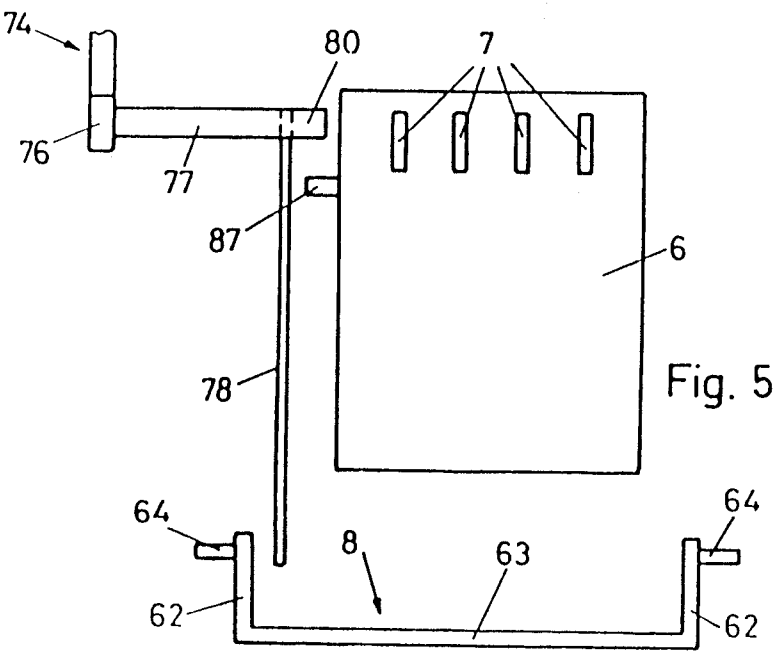
FIG. 5 is a front elevational view of a coin receiving station in accordance with the invention.

Reference is now also made to FIG. 8 in which a sectional view of arm 37 is provided. Arm 37 includes a plate 101 which is bent in U-shape and which is open towards the top. Two legs 102 each have an opening in the rear, through which axle 38 penetrates. At the front each leg 102 has an opening for receiving axle 40. A pin 103 adjoining the rear end of arm 37 penetrates the legs 102. A U-shaped cover 104 is pivotably mounted on the pin 103. Cover 104 covers the interior space of the U-shaped plate 101 and can be flipped up for maintenance purposes. Stop 44*a* is fastened on cover 104.

Roller 39 has a circular cylindrical smooth lower half roll surface 105 coaxial with axle 40. When activation device 30 retracts, roll surface 105 rolls on the previously pushed-ahead newspaper 23*a*, so that in the initial phase of the backwards motion roller 39 rolls off on the pushed-ahead newspaper 23 and is thus brought back into the starting position.

In this starting position, armature 42 latches behind radial surface 44 due to the spring force. Slide 45 is also a plate that is bent U-shaped. Upwardly bent legs 106 of plate 45 surround the plate 101. A longitudinal hole 47*a* is formed in the web of the U-plate 101. A pin 46*a* which penetrates the longitudinal hole 47*a* anchors one end of a tension spring 107, the other end of which is anchored to pin 103. Spring 107 pulls slide 45 rearwards and upwards relative to arm 37 into the position shown in FIG. 8.

In this position, pin 46*a* strikes against the rear end of the longitudinal hole 47*a* and roll surface 105 protrudes downwardly over the forward end 108 of legs 106 which laterally surround roller 39. When the rear end of slide 45 contacts stopping block 26, slide 45 is pushed forward relative to arm 37 against the force of spring 107. Forward end 108 of leg 106 is then supported on stack 22 and the inclined front edge 48 lifts axle 40 upwards lifting roller 39 off stack 22.

The vending machines described above can be operated with batteries and these can be charged e.g. with solar cells. For this purpose, it is advantageous to minimize current consumption. The spring which pushes the armature 42 forwards should be designed as weak as possible so that the current needed to activate the magnet 43 is small. However, with this design, when activation device 30 is forcibly struck at its rear end, armature 42 is pushed into magnet 43 due to the inertia, so that spikes 41 can fall down. To prevent this, roller 39, in the representation according to FIG. 8, has a counterweight 109 on top and has holes 110 in lower circular-cylindrial segment 105 so that the center of gravity 111 of roller 39 lies to the left of axle 40 and above the plane defined by axle 40 and spikes 41. When an impact which sufficient to push armature 42 into magnet 43 against the force of its spring, roller 39 is turned clockwise by inertia, so that the spikes 41 are raised. In this way, a release of the spikes 41 as a result of jolts can be prevented.

Stopping block 26 in combination with slide 45 keeps arm 37 up while table 15 is being reloaded.

The above-described design of arm 37 in combination with roller 39 and slide 45 makes it possible for newspapers 23 to be separated very reliably. Because slide 45, in its base position, is supported directly under roller 39 on stack 22, roller 39 is reliably raised from the uppermost newspaper even when the stack is slanted so that roller 39 pivots reliably when magnet 43 is activated. The return of the roll to its base position by rolling off also is an extraordinarily reliably solution.

The above-described design of the activation device is indeed preferred, but the previously described design of the coin handling equipment by means of the coin handling station can also be used with other activation devices.

Figure 9:
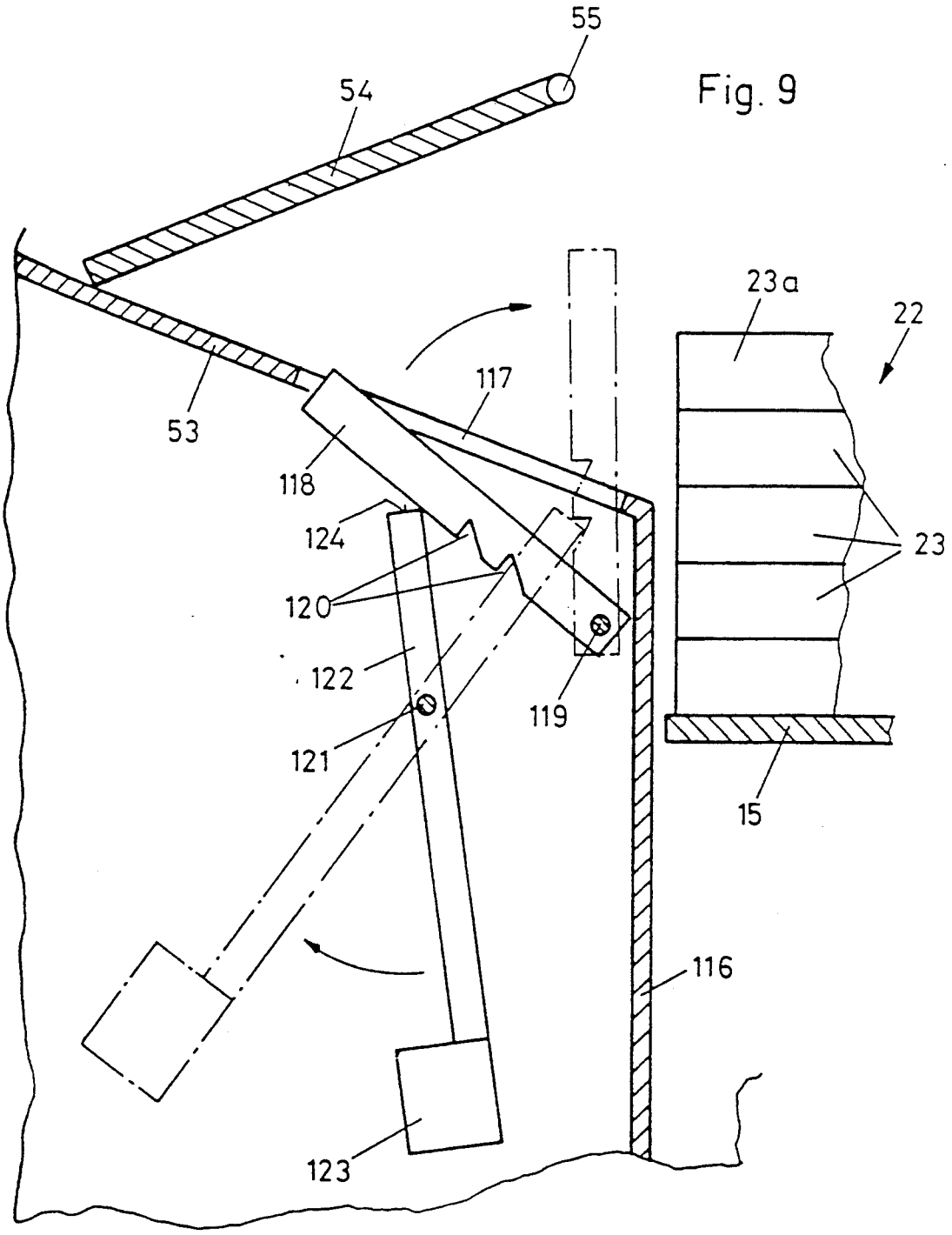
FIG. 9 is a side elevational view of a lock in accordance with the invention.

Reference is now made to FIG. 9 in which a sectional view of a lock for preventing the dispensing of newspapers without payment is provided. Guide plate 53 is bent downwards at its rearward edge forming a vertical forward guide wall 116 for the forward edges of newspapers 23 of stack 22. Two slots 117 are recessed into guide plate 53 adjoining wall 116. Slots 117 are disposed symmetrically with respect to the center. A blocking lever 118 extends into each of slots 117. Blocking levers 118 are parallel to one another and are fastened on the rotatably mounted rod 119. One of blocking levers 118 has two detent recesses 120 on its front side. In its base position, shown by solid lines, blocking lever 118 rests on the upper end of an activation lever 122, which can pivot about a horizontal axle 121. Its lower end is loaded by a weight 123. If the vending machine is tilted forward in an attempt to shake out the uppermost newspaper 23*a* from the withdrawal slot, the activation lever 122 swings into the position shown by the dots and dashes by virtue of the weight 123. Its upper front side 124 pushes the blocking lever 118 into a vertical position. When the vending machine is inclined so strongly that the uppermost newspaper 23*a* slides off stack 22, it strikes against blocking levers 118 and thus does not reach withdrawal slot 5. By detaining front end 124 of activation lever 122 in detent recesses 120, even relatively heavy newspapers can be held back.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A vending machine for multi-page print products (23), comprising:

a housing (1) having a withdrawal slot (5) therethrough;

a support table (15) for receiving a supply stack (22) of multi-page print products (23) disposed within the housing (1), the table (15) being vertically movable and upwardly biased;

activation means (30) for causing the ejection of the multi-page print products (23), the activation means including a control handle (35) and having at least one projection (41) to push out the uppermost newspaper (23*a*) of the stack (22) into the withdrawal slot (5);

an arm (37) disposed above the support table (15) pivotably supported at its rear section for pivoting about an approximately horizontal first axle (38), a roller (39) mounted at the front end of the arm (37) so as to pivot about a horizontal second axle (40), the projection (41) mounted on the roller (39); electromagnet means including an element (42) that can be activated by an electromagnet (43) for maintaining the roller in a first at rest position, whereby in the first position the projection (41) is spaced apart from the stack (22);

a coin receiving station (6) coupled to the electromagnet means to activate the element (42) and to lower the projection (41) onto the stack (22) when a correct amount of coins has been received by the coin receiving station (6);

the roller (39) being formed with a roller surface (105, 39) substantially coaxial with the second axle (40), the roller surface (105) lying on a pushed-ahead product (23*a*) when the arm (37) is moved backwards and upon rolling off the pushed-ahead product (23*a*) returning the roller (39) into the first position in which the element (42) catches the roller (39); and raising means (40, 45, 48) disposed at the arm (37) for raising the roller (39) off the stack (22) in the rearwardly limited position of the activation means (30) the raising means resting on the stack (22) adjacent the roller (39) in the rearwardly limited position.

2. A vending machine according to claim 1, wherein the raising means (40, 45, 48) for raising the roller (39) includes a slide (45) having a slanted surface (48) adjacent the roller (39); the raising means being movable longitudinally along the arm (37) and pivotable relative to the arm (37), a spring (107) biasing the slide (45) rearwardly and upwardly; a stopping element (26) affixed to the housing (1) wherein in the rearward limit position of the activation means (30) the slide (45) abuts against the stopping element (26) and is moved forward relative to the arm (37), is supported on the stack (22) and with the slanted surface (48) lifts the front end of the arm (37) containing the roller (39) off the stack (22).

3. A vending machine according to claim 1, wherein the roller (39) includes a counter weight (109) diametrically opposite the roller surface (105) so that the center of gravity (111) of the roller (39) is disposed above the plane defined by the second axle (40) and the projection (41).

4. A vending machine according to claim 1, further comprising an intermediate coin handling station (8) disposed below the coin receiving station (6), the intermediate coin handling station (8) being pivotable from a horizontal base position (M) in either of two directions; a collection container (9) disposed adjacent the intermediate coin handling station (8); a return cup (11) disposed adjacent the intermediate coin handling station (8) and leading to the outside of the housing (1) a sensor (59) disposed adjacent the withdrawal slot (5) and connected to the intermediate coin handling station (8) for pivoting the intermediate coin handling station (8) into a first discharge position (A), where the coins in the intermediate coin handling station (8) are tilted into the collection container (9) when the newspaper (23*a*) emerges from the withdrawal slot (A); and wherein a lug (71) is disposed on the activation means (30) for tilting the intermediate coin handling station (8) into a second discharge position (B), the lug (71) tilting the coins in the intermediate coin handling station (8) into a return cup (11) when the control handle (35) is fully activated.

5. A vending machine according to claim 4, wherein the sensor (59) is a pivoting lever (58), which in its base position extends into the path towards the withdrawal slot (5), and which is connected to the intermediate coin handling station (8) through a transmission linkage (61) so that the intermediate coin handling station (8) tilts into the first discharge position (A) when the pivoting lever (58) is pivoted by the newspaper (23*a*) that is introduced into the withdrawal slot (5).

6. A vending machine according to claim 5, wherein the transmission linkage includes a spring (61) which yields flexibly in two directions and has a first end anchored to the pivoting lever (58) and a second end anchored to the intermediate coin handling station (8).

7. A vending machine according to claim 5, further including a guide element (53) which is fixed in the housing, adjoining the lower edge of the withdrawal slot (5) having a slot (56) therein, the pivoting lever (58) extending through the slot (56) when in the base position; and wherein a holder plate (54) having a rear end pivotably attached to the housing (1) forms an acute angle with the guide element (53), the forward edge of the holder plate (54) resting on the guide element (53) next to the pivoting lever (58) and being raised by the newspaper (23*a*) being ejected.

8. A vending machine according to claim 4, further including a double arm pivoting lever (74) having a first arm (73) and a second arm (76); the lug (71) of the activation means (30) abutting against a free end of the first arm (73) of the double-arm pivoting lever (74) when the control handle (35) is almost completely activated; and the free end of the second arm (76) of the double-arm lever (74) carrying a protrusion (78) to press down the intermediate coin handling station (8) into a second discharge position (B).

9. A vending machine according to claim 1, further including at least two pulley elements (16) the table (15) being suspended at at least two lateral edges (17, 18) by the pulley elements (16) respectively, the pulley elements (16) being tensioned by respective springs (21) in cooperation with a common pulley block.

10. A vending machine according to claim 4, wherein the lug (71) is operatively connected to the coin receiving station (6) wherein when the control handle (35) is fully activated, storage channels (86) in the coin receiving station (6) which hold defective coins are discharged directly into the return cup (11).

11. A vending machine as claimed in claim 1, further including four traction elements (16), table (15) being suspended at two lateral edges (17, 18) by the respective traction, element (16) each traction element pair (16) being tensioned respectively by a common spring (21) in cooperation with a common pulley block independently suspended on either side of the table (15).

12. A vending machine for multi-page print products (23), comprising:

a housing (1) having a withdrawal slot (5) therethrough;

a support table (15) for receiving a supply stack (22) of multi-page print products (23) disposed within the housing (1), the table (15) being vertically movable and upwardly biased;

activation means (30) for causing the ejection of the multi-page print products (23), the activation means including a control handle (35) and having at least one projection (41) to push out the uppermost newspaper (23*a*) of the stack (22) into the withdrawal slot (5);

an arm (37) disposed above the support table (15) pivotably supported at its rear section for pivoting about an approximately horizontal first axle (38), a roller (39) mounted at the front end of the arm (37) so as to pivot about a horizontal second axle (40), the projection (41) mounted on the roller (39); electromagnet means (43) including an element (42) that can be activated by the electromagnet means (43) for maintaining the roller in a first at rest position, whereby in the first position the projection (41) is spaced apart from the stack (22);

a coin receiving station (6) coupled to the electromagnet means (43) to activate the element (42) and to lower the spike (41) onto the stack (22) when a correct amount of coins has been received by the coin receiving station (6);

the roller (39) being formed with a roller surface (105, 39) substantially coaxial with the second axle (40), the roller surface (105) lying on a pushed-ahead product (23*a*) when the arm (37) is moved backwards and upon rolling off the pushed-ahead product (23*a*) returning the roller (39) into the first position in which the element (42) catches the roller (39); and raising means (40, 45, 48) disposed at the arm (37) for raising the roller (39) off the stack (22) in the rearwardly limited position of the activation device (30), the raising means including a slide (45) having a slanted surface (48) opposite the roller (39), the raising means being movable longitudinally along the arm (37) and pivotable relative to the arm (37), a spring (107) biasing the slide (45) rearwardly and upwardly; a stopping element (26) affixed to the housing (1) wherein in the rearward limit position of the activation means (30) slide (45) abuts against the stopping element (26) affixed to the housing (1) and is moved forward relative to the arm (37), is supported on the stack (22) and with the slanted surface (48) lifts the front end of the arm (37) off the stack (22).

13. A vending machine according to claim 12, wherein the roller (39) includes a counter weight (109) diametrically opposite the roller surface (105) so that the center of gravity (111) of the roller (39) is disposed above the plane defined by the second axle (40) and the projection (41).

* * * * *